US007976013B1

(12) United States Patent
Young

(10) Patent No.: US 7,976,013 B1
(45) Date of Patent: Jul. 12, 2011

(54) CYCLICALLY CONTROLLED PAPER FEEDER WITH OPTICAL STACK LEVEL CONTROL

(76) Inventor: Ronald J. Young, Apple Valley, CA (US)

( * ) Notice: Subject to any disclaimer, the term of this patent is extended or adjusted under 35 U.S.C. 154(b) by 506 days.

(21) Appl. No.: 12/070,740

(22) Filed: Feb. 22, 2008

(51) Int. Cl.
*B65H 1/08* (2006.01)

(52) U.S. Cl. ..... 271/30.1; 271/11; 271/107; 271/108; 271/152; 271/154

(58) Field of Classification Search ..... 271/11, 271/90, 107, 30.1, 31, 108
See application file for complete search history.

(56) References Cited

U.S. PATENT DOCUMENTS

| | | | | |
|---|---|---|---|---|
| 1,768,586 | A | 7/1930 | Farley | |
| RE20,862 | E | 9/1938 | Harrold | |
| 2,183,077 | A | 12/1939 | Kast | |
| 2,225,006 | A | 12/1940 | Gudger et al. | |
| 2,819,074 | A | 1/1958 | Williams | |
| 2,838,306 | A | 6/1958 | Williams | |
| 2,999,686 | A | 9/1961 | Cheeseman et al. | |
| 2,999,687 | A | 9/1961 | Hommel | |
| 3,201,114 | A | 8/1965 | Swartz et al. | |
| 3,409,149 | A | 11/1968 | Graux | |
| 3,659,838 | A | 5/1972 | Davis et al. | |
| 3,861,668 | A | 1/1975 | Wood | |
| 3,879,031 | A | 4/1975 | Melehan | |
| 3,893,664 | A | 7/1975 | Thomsen | |
| 4,090,702 | A * | 5/1978 | Wirz | 271/108 |
| 4,427,192 | A * | 1/1984 | Kushmaul et al. | 271/11 |
| 4,958,824 | A | 9/1990 | Willits et al. | |
| 5,052,672 | A | 10/1991 | Horii | |
| 5,076,565 | A * | 12/1991 | Liepert | 271/14 |
| 5,088,716 | A * | 2/1992 | Wirz | 271/90 |
| 5,110,110 | A | 5/1992 | Wirz et al. | |
| 5,253,858 | A * | 10/1993 | Grieve | 271/103 |
| 5,263,699 | A | 11/1993 | Selak et al. | |
| 5,427,365 | A * | 6/1995 | Torisawa | 271/11 |
| 5,556,252 | A * | 9/1996 | Kuster | 414/796.7 |
| 5,685,534 | A * | 11/1997 | Zeltner | 271/108 |
| 5,833,228 | A * | 11/1998 | Nagata et al. | 271/11 |
| 5,884,907 | A * | 3/1999 | Ohkoda | 271/90 |
| 6,299,155 | B1 * | 10/2001 | Fujii et al. | 271/108 |
| 6,502,815 | B1 * | 1/2003 | Baureis et al. | 271/11 |
| 6,834,851 | B2 * | 12/2004 | Jensen | 271/98 |

* cited by examiner

*Primary Examiner* — Jeremy Severson
(74) *Attorney, Agent, or Firm* — William W. Haefliger

(57) ABSTRACT

In paper feeder apparatus, the combination comprising first means including a support for a paper stack and transfer elements for successively transferring paper sheets from the top of the stack upwardly and laterally to a delivered position, and optical control means to determine the level of an upper paper or papers in the stack to control the vertical positioning of papers on the stack, to enable said upwardly and laterally sheet delivering as the stack height diminishes, and a controller for cyclically controlling said transfer elements to integrate cyclic upward and lateral movement of successive sheets transferring from the stack.

12 Claims, 14 Drawing Sheets

30
28
26
17a
17
30
34
31
21
27
22
33
16
16a
13a
29
20
25
~13~
77
14

FIG. 12.
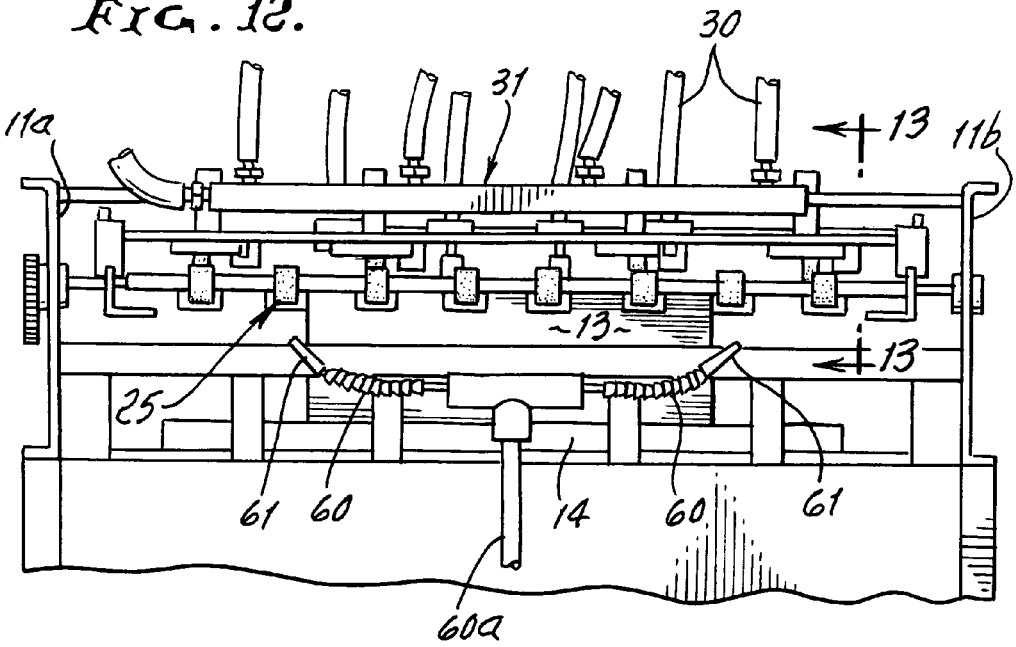
FIG. 13.
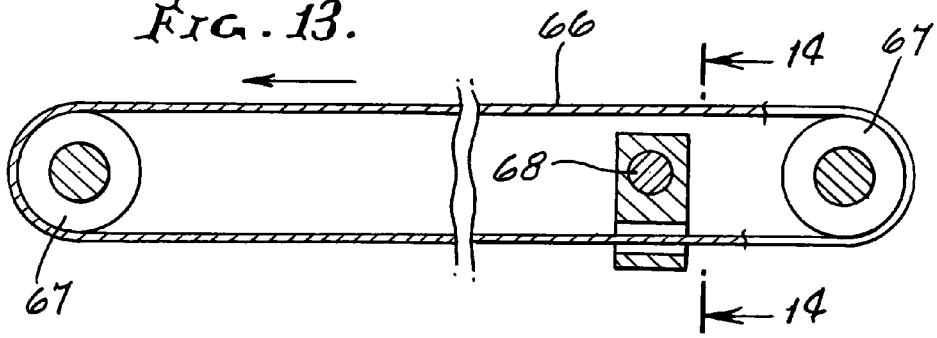
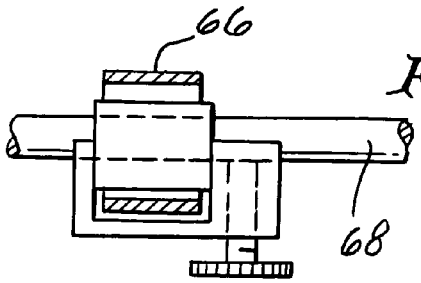
FIG. 14.

FIG. 15.
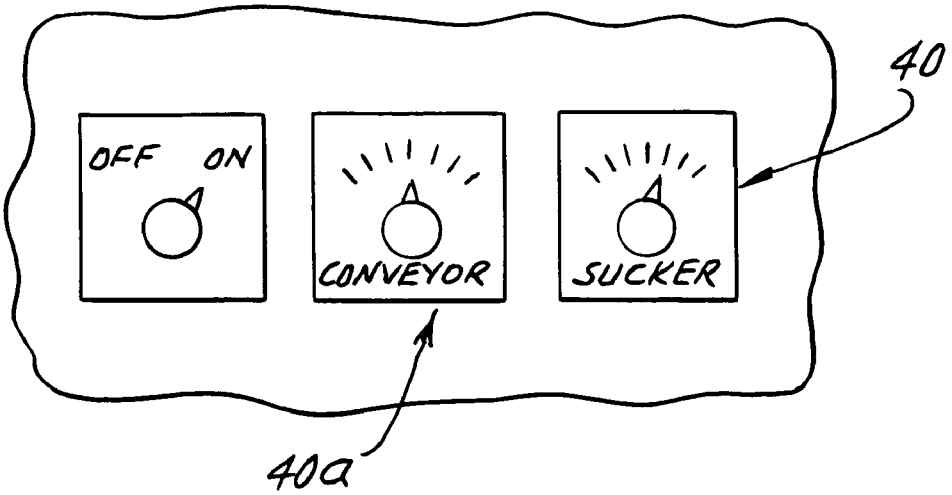
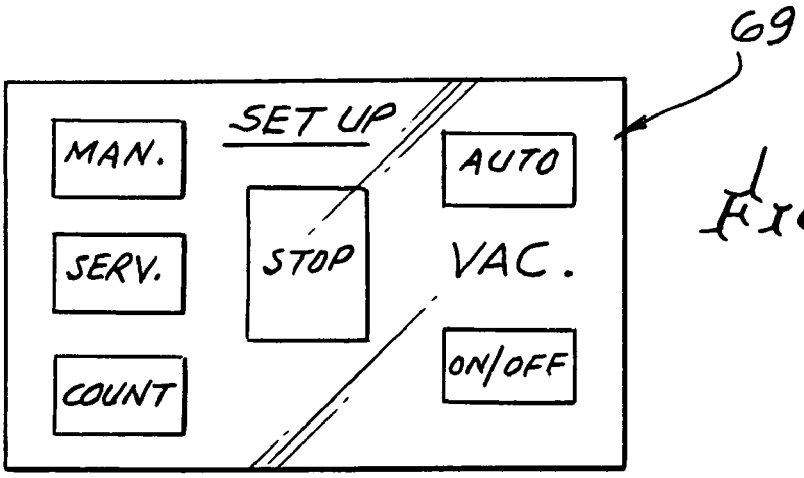
FIG. 16.
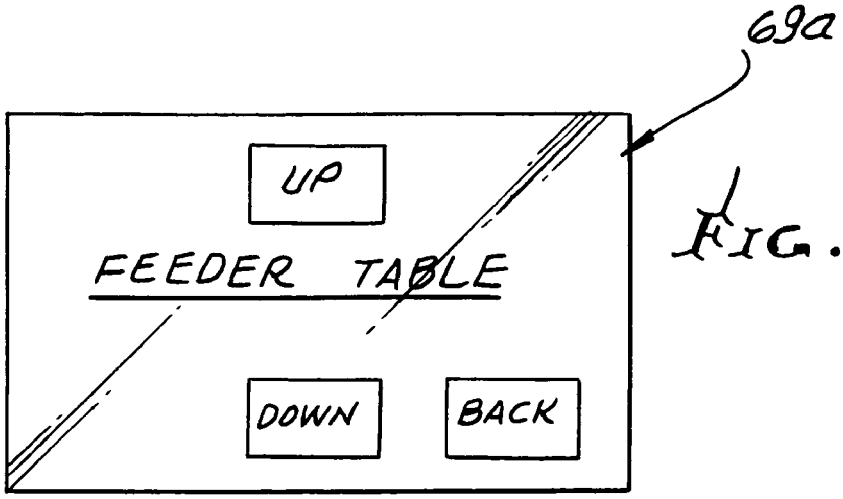
FIG. 17.

CYCLICALLY CONTROLLED PAPER FEEDER WITH OPTICAL STACK LEVEL CONTROL

BACKGROUND OF THE INVENTION

This invention relates generally to paper feeding apparatus and methods, and more particularly concerns the provision of highly effective and reliable apparatus and methods for paper feeding, as will be seen.

There is need for apparatus and methods as described herein, that achieve significant improvements in structure, operation and results, over prior paper feeding.

SUMMARY OF THE INVENTION

It is a major object of the invention to provide improved apparatus and methods of operation, meeting the above need.

Basically, the paper feeding apparatus of the invention comprises:

a) a first means including a support for a paper stack and transfer elements for successively transferring paper sheets from the top of the stack upwardly and laterally to a delivered position, b) optical control means to determine the level of an upper paper or papers in the stack to control the vertical positioning of papers in the stack, to enable said upwardly and laterally sheet delivery as the stack height diminishes, c) and a controller for cyclically controlling the transfer elements to integrate cyclic upward and lateral movements of successive sheets transferring from the stack.

As will be seen, the optical control means typically includes an optical sensor positioned for sensing the top level of the paper stack.

It is another object of the invention to provide one of the transfer elements to include suction means operable to successively adhere to top papers in the stack during up-down cyclic operation of suction means as controlled by cam controller motion. The suction means may include multiple suction elements on a transverse shaft that is bodily movable under the control of the cam controller.

A further object is to provide a first shaft cyclically rotatable to control up-down movement of the suction means, and a second shaft cyclically rotatable to control lateral movement of the suction means, said shafts extending in parallel relation. Also, the drives for the shafts control cyclic pivoting thereof in predetermined sequence.

An additional object include provision of a conveyor to which paper sheets are delivered, and drive means for delivering paper sheets from said first means to the conveyor, at controlled rates.

Yet another object concerns provision of a method for feeding paper from a stack, that includes a) providing first means including a support for a paper stack and transfer elements for successively transferring paper sheets from the top of the stack upwardly and laterally to a delivered position, b) providing optical control means to determine the level of an upper paper or papers in the stack to control the vertical positioning of papers in the stack, to enable the upward and lateral delivery of successive sheets as the stack height diminishes, c) providing means to control the timing of suction application to suction cups that lift paper sheets.

These and other objects and advantages of the invention, as well as the details of an illustrative embodiment, will be more fully understood from the following specification and drawings, in which:

DRAWING DESCRIPTION

Figure 6:
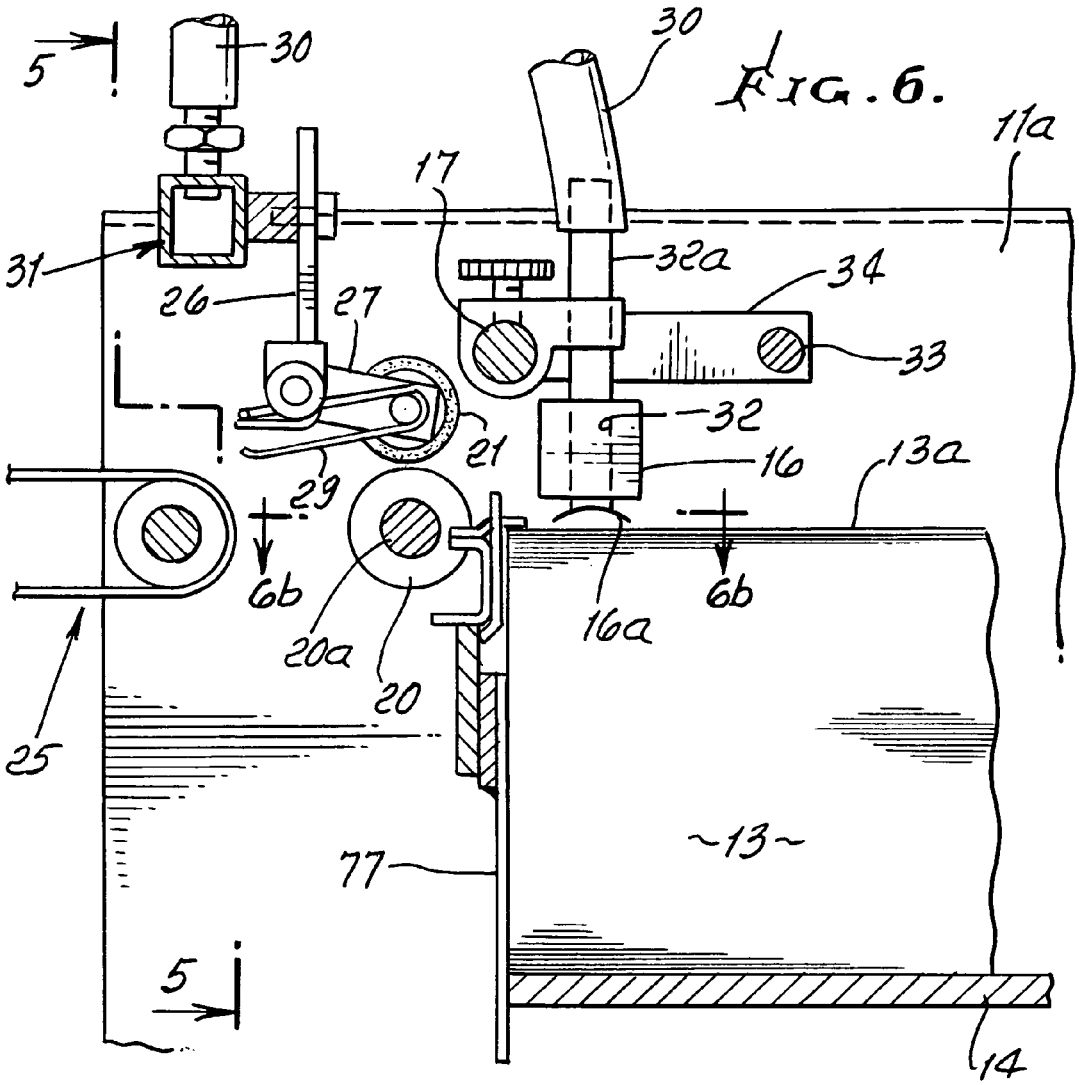
FIG. 6 is view showing details of operation.
Figure 6B:
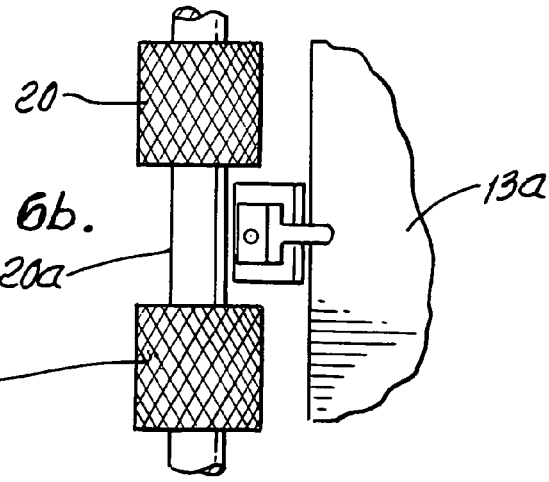
Figure 6A:
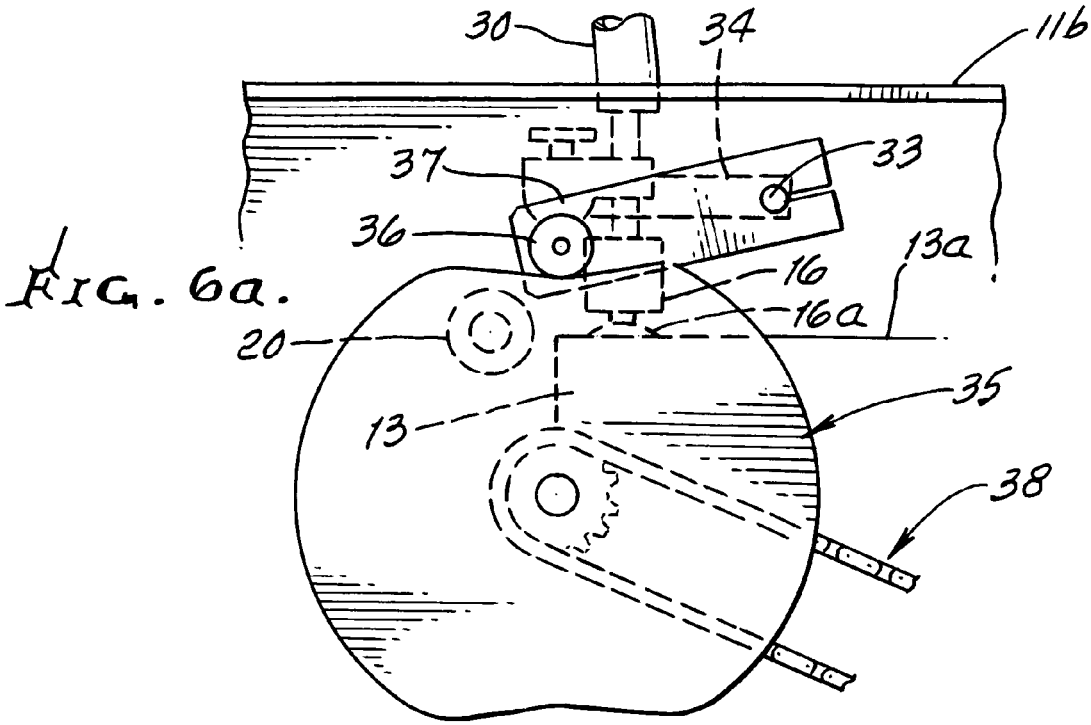
Figure 7A:
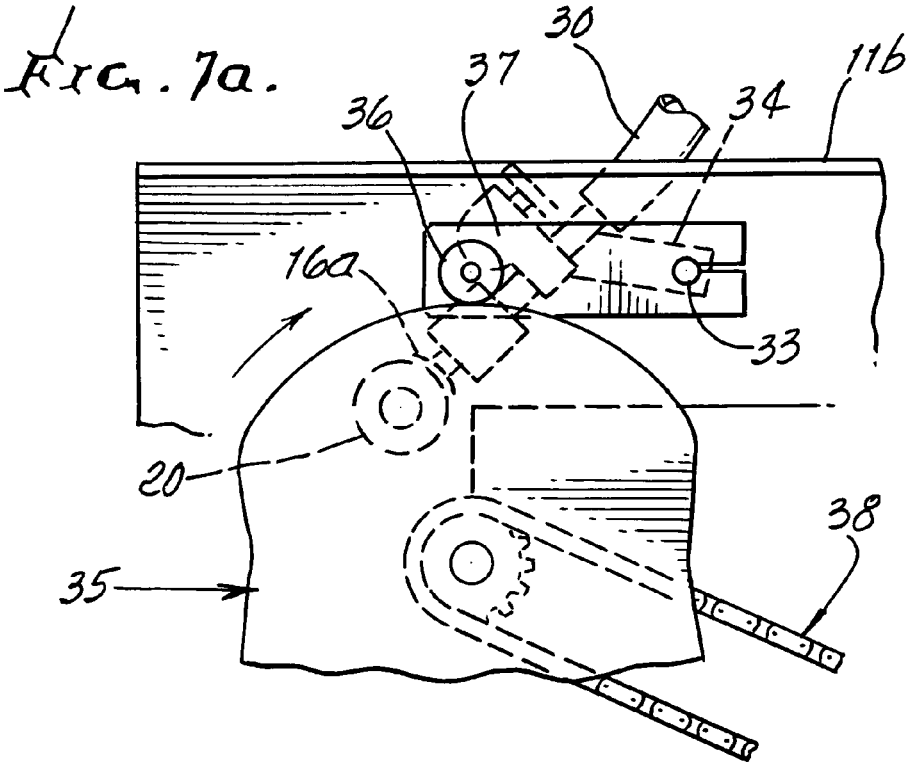
Figure 7:
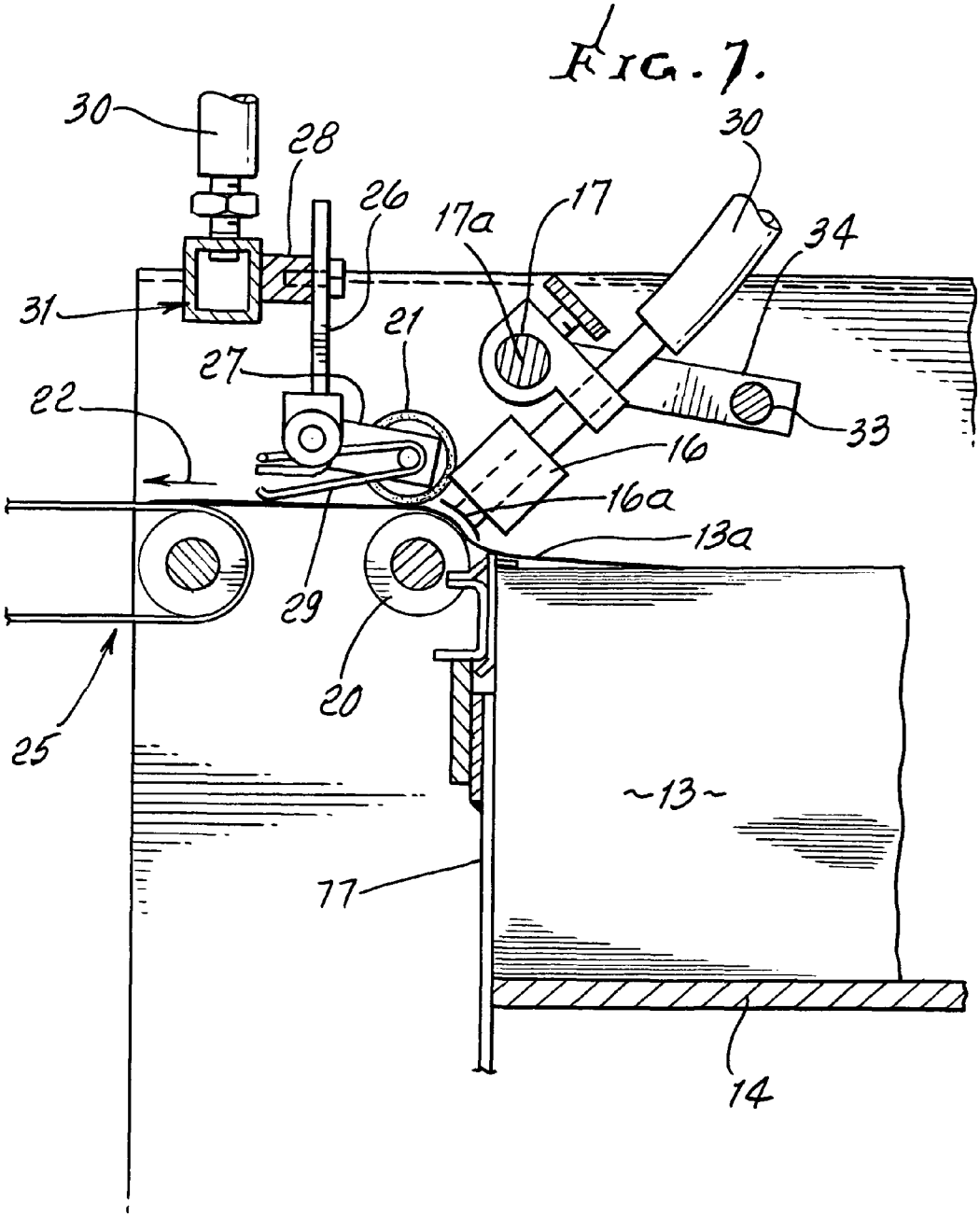

FIG. 6*a* is an enlarged view showing cam cyclic control of a paper transfer element;

FIG. 6*b* is an enlarged fragmentary plan view taken on lines 6*b*-6*b* of FIG. 6;

FIG. 7 is an enlarged view like FIG. 6, but showing a stage of paper transfer toward a conveyor;

FIG. 7*a* is a view like FIG. 6*a* showing a rotated position of the cam seen in FIG. 6*a;*

Figure 1:
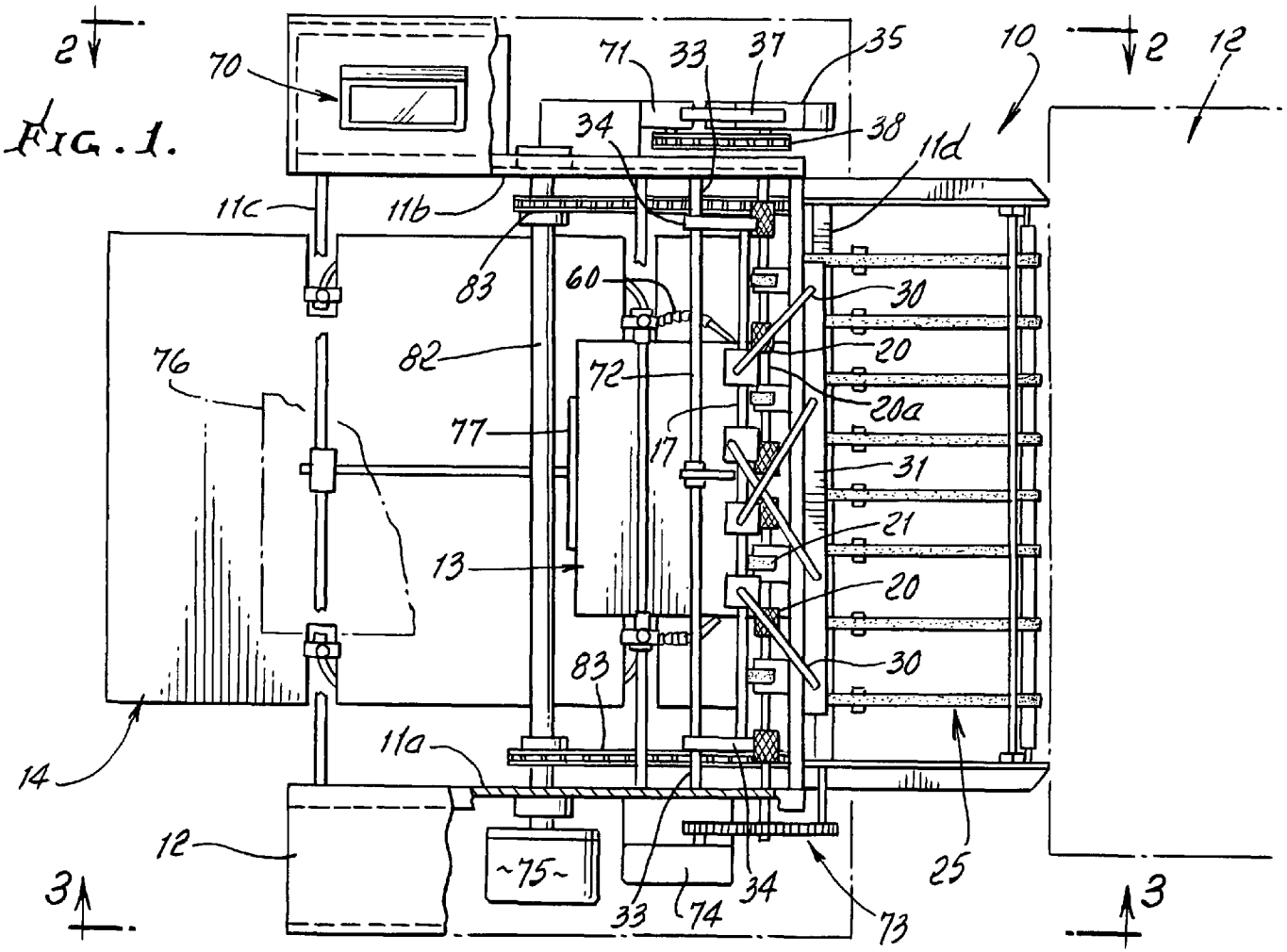
FIG. 1 is a top plan view of the apparatus incorporating the invention.
Figure 8:
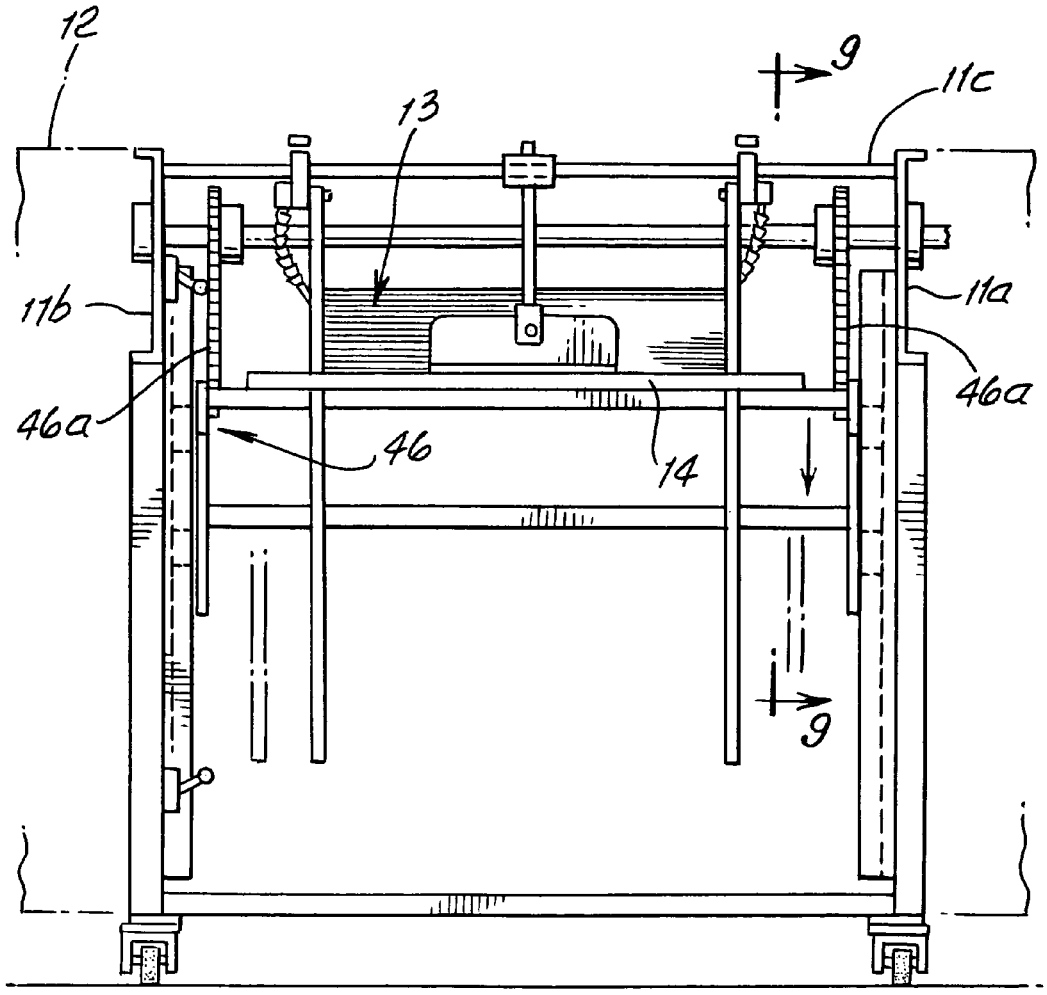
Figure 9:
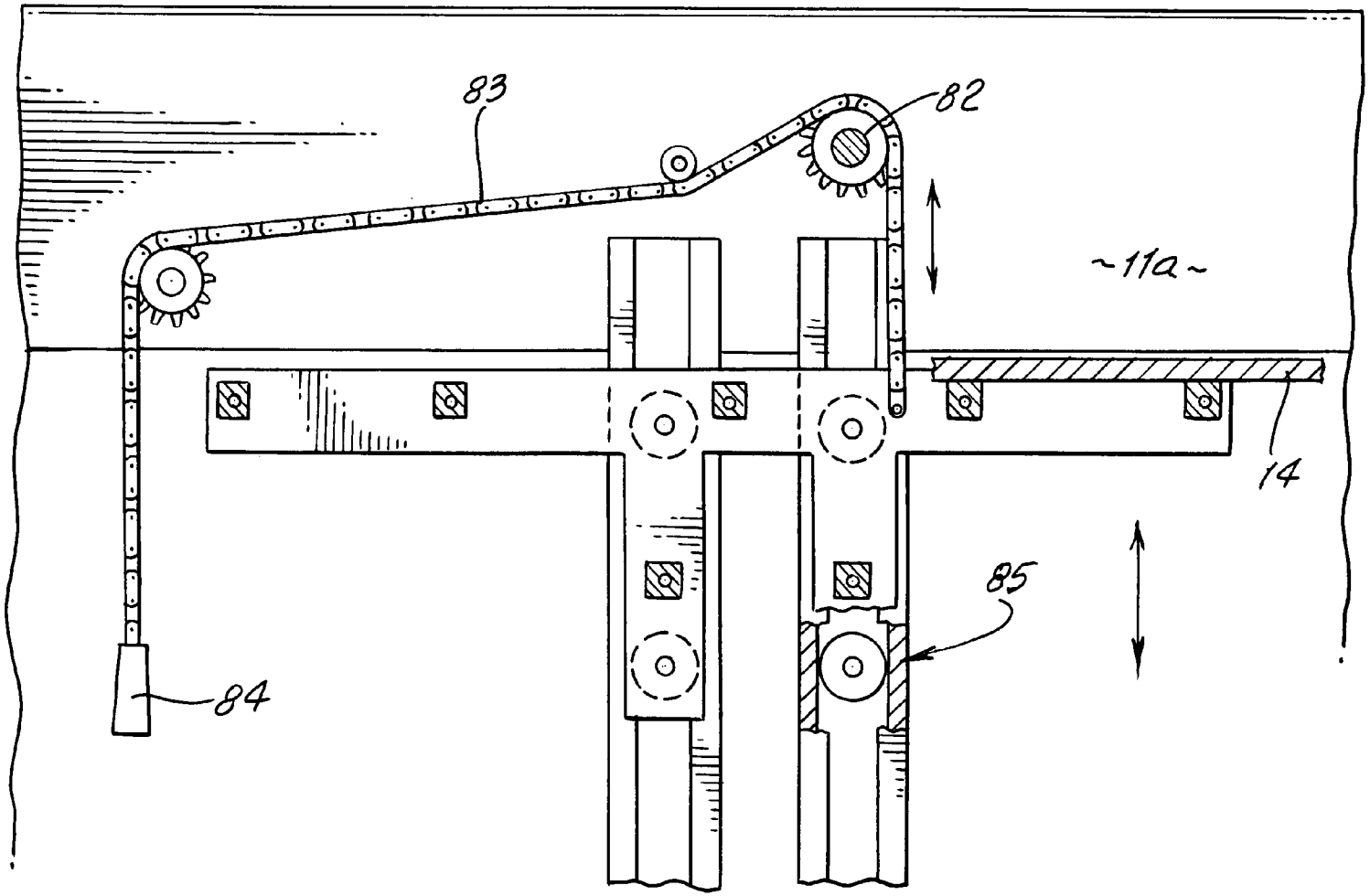
Figure 11:
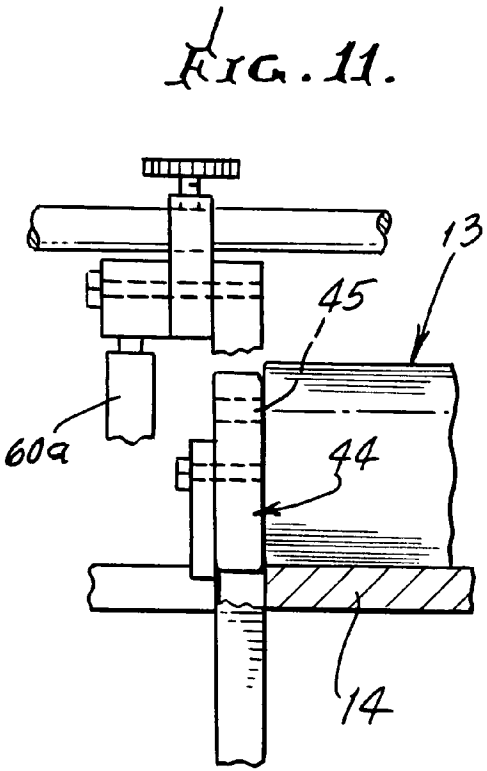
Figure 10:
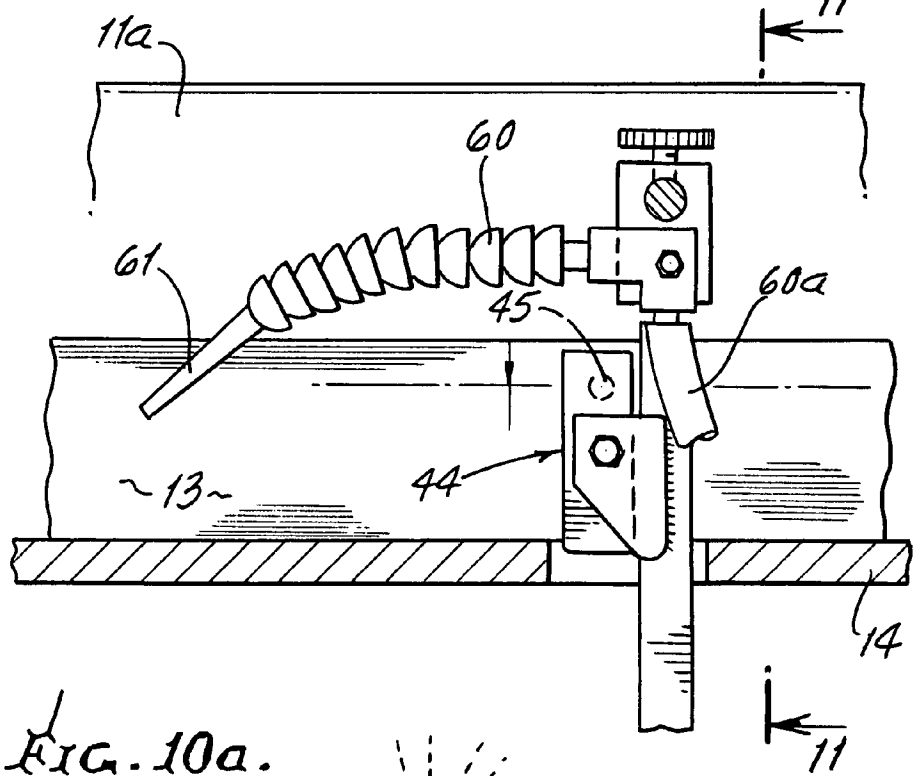
Figure 10A:
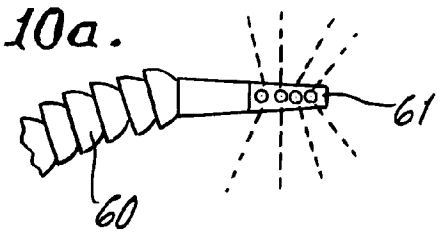

FIG. 8 is a front view of the FIG. 1 apparatus;

FIG. 9 is a vertical section taken on lines 9-9 of FIG. 8;

FIG. 10 is a fragmentary and enlarged elevation showing optical control of the top level of paper in the stack being fed;

FIG. 10*a* shows air delivery from a hose nozzle;

FIG. 11 is a vertical section taken on lines 11-11 of FIG. 10;

FIG. 12 is a rear view of the FIG. 1 apparatus;

FIG. 13 is a section taken on lines 13-13 of FIG. 12;

FIG. 14 is a section taken on lines 14-14 of FIG. 13;

FIGS. 15-17 show control panel instrumentation; and

Figure 18:
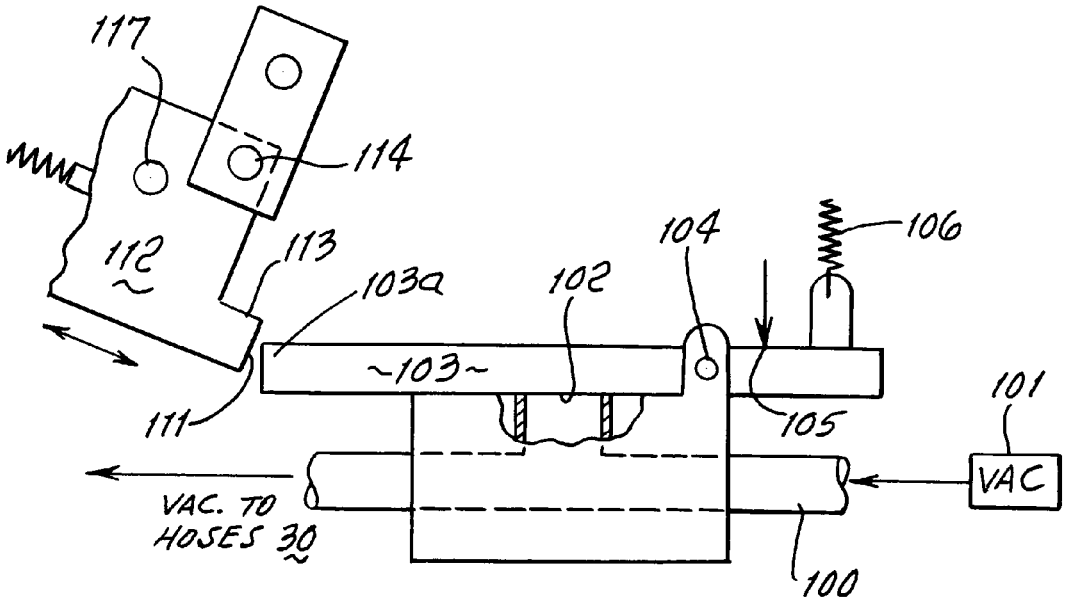
Figure 19:
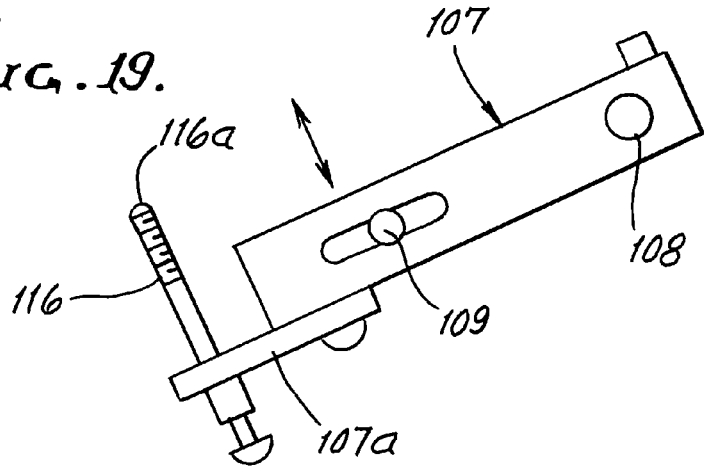

FIGS. 18 and 19 show mechanism for control of vacuum supplied to suction means for paper lifting.

DETAILED DESCRIPTION

In the drawings, the preferred apparatus 10 includes upright frame parts 11*a*-11*d* and a cover 12. A stack of paper 13 is carried by a horizontal table 14 to be controllably elevated so as to present top paper sheets 13*a* at generally the same level, and so as to be transportable sidewardly toward a conveyor 25. See FIG. 7. The paper may be delivered by the conveyor to means, such as a U.V. coater 120, or other means Accordingly, a first means is provided to include a support such as table 14 for the stack 13, for successively transferring paper sheets from the top of the stack to a delivered position.

Figure 4:
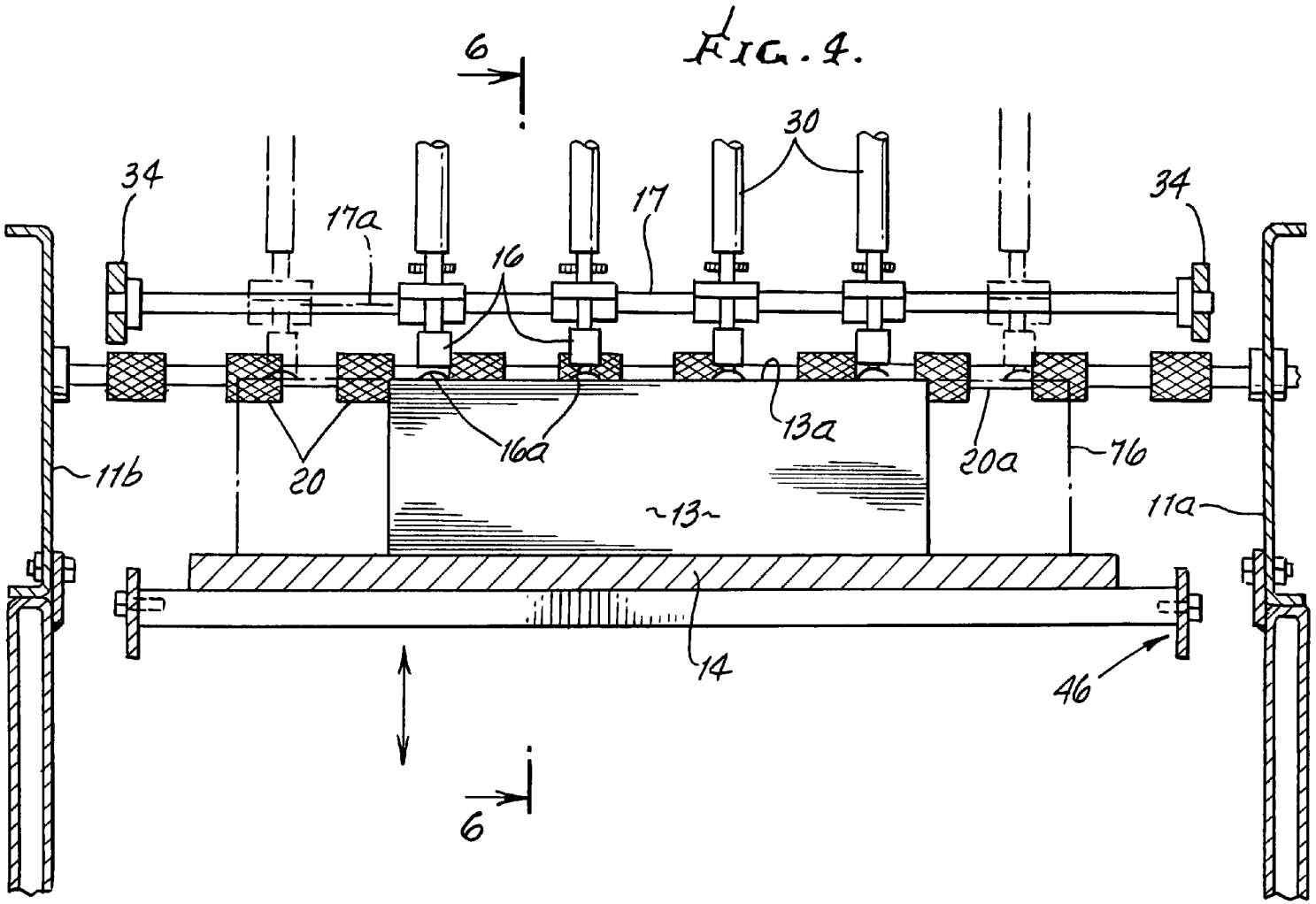
FIG. 4 is an enlarged vertical section taken on lines 4-4 of FIG. 2.
Figure 5:
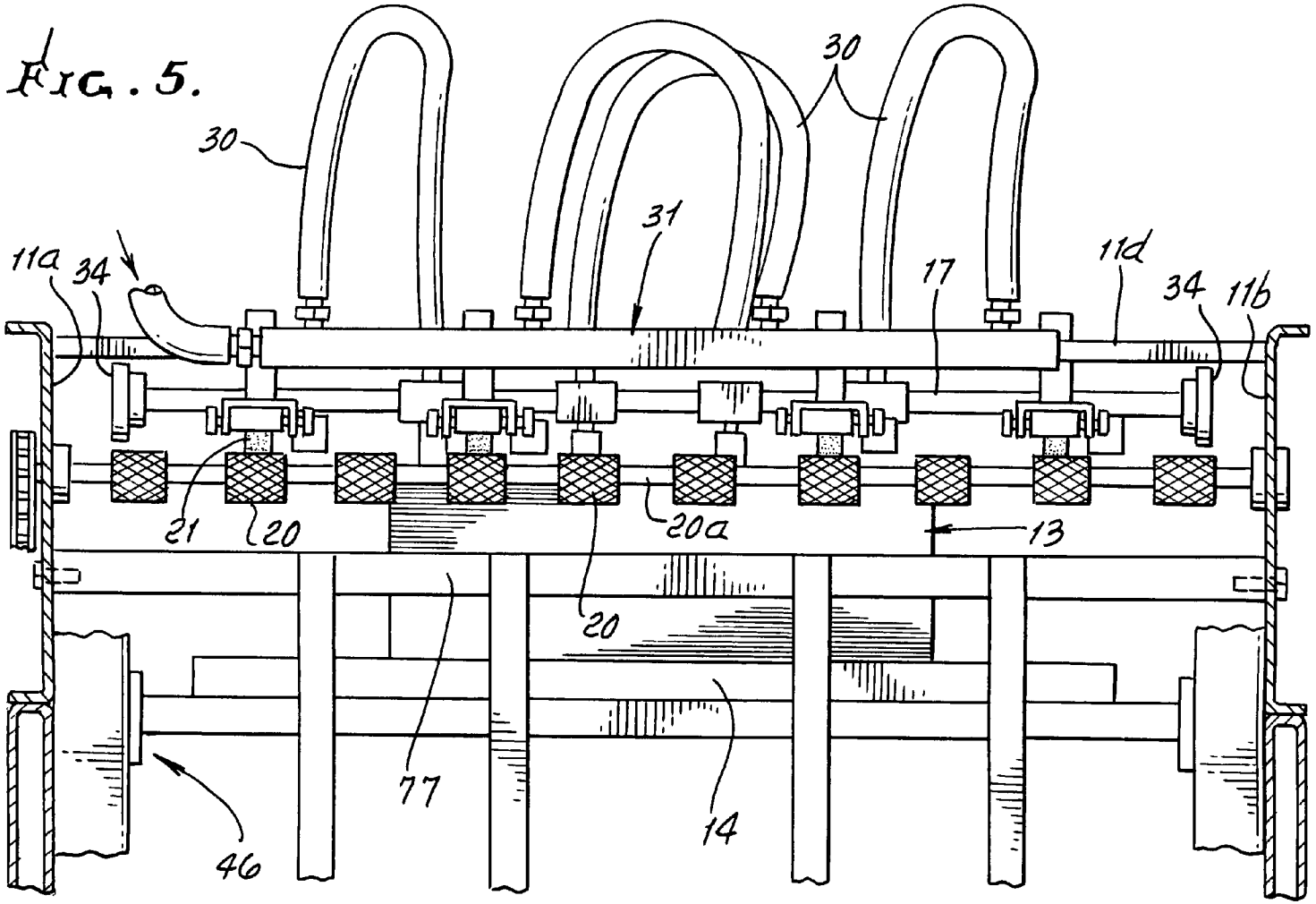
FIG. 5 is an enlarged vertical section taken on lines 5-5 of FIG. 3.

That first means, as shown, includes a suction means operable to successively adhere to the tops of successive papers in the stack, during cyclic operation of the suction means. That suction means may typically include a transverse row of suction heads 16 carrying suction cups 16*a*. See FIG. 4. The heads are carried by a transverse shaft 17 that is pivotable about a transverse axis 17*a* to move the heads 16 positioning as seen in FIG. 6 directly above the stack 13, for suction elevation of the top sheet 13*a*, to secondary positions as seen in FIG. 7, in which the heads and suction cups have been swung to transport and swing the top sheet 13*a* for feed between rollers 20 and 21 as seen in FIG. 7. Roller 20 is typically a paper sheet driver roller, on shaft 20*a* and roller 21*a* guide roller, (i.e. upper feed roller driven by 20), to effect leftward bodily travel of sheet 13*a* onto conveyor 25. See arrow 22. Guide roller support structure includes vertically adjustable post 26 carrying roller support flanges 27, and transverse support member 28 that carries all of the multiple guide elements. Flat spring members 29 supported by 27 bear on the top of the paper sheet 13*a*, to prevent buckling, as the sheet advances toward 25.

Suction at the cups is provided via air suction hoses 30 operatively connected between a transverse suction manifold 31, and suction channels 32 in heads 16 leading to the cups, and support ducting 32*a* extending between the hoses and the head channels. See FIG. 6.

As referred to, shaft 17 is cyclically pivoted, as between positions as seen in FIGS. 6 and 7. Also, shaft 17 is elevated or lifted as appears in FIG. 7, to elevate the suction cups with paper held thereby, to lift the paper off the stack, to enable its edgewise feeding laterally between rollers 20 and 21, free of the stack 13. The lifting and guiding means includes the pivotable shaft 33 and link or links 34 that carry shaft 17, and which are swung (between FIGS. 6 and 7 position) in response to pivoting of shaft 33. Link or links 34 are carried by 33.

Figure 2:
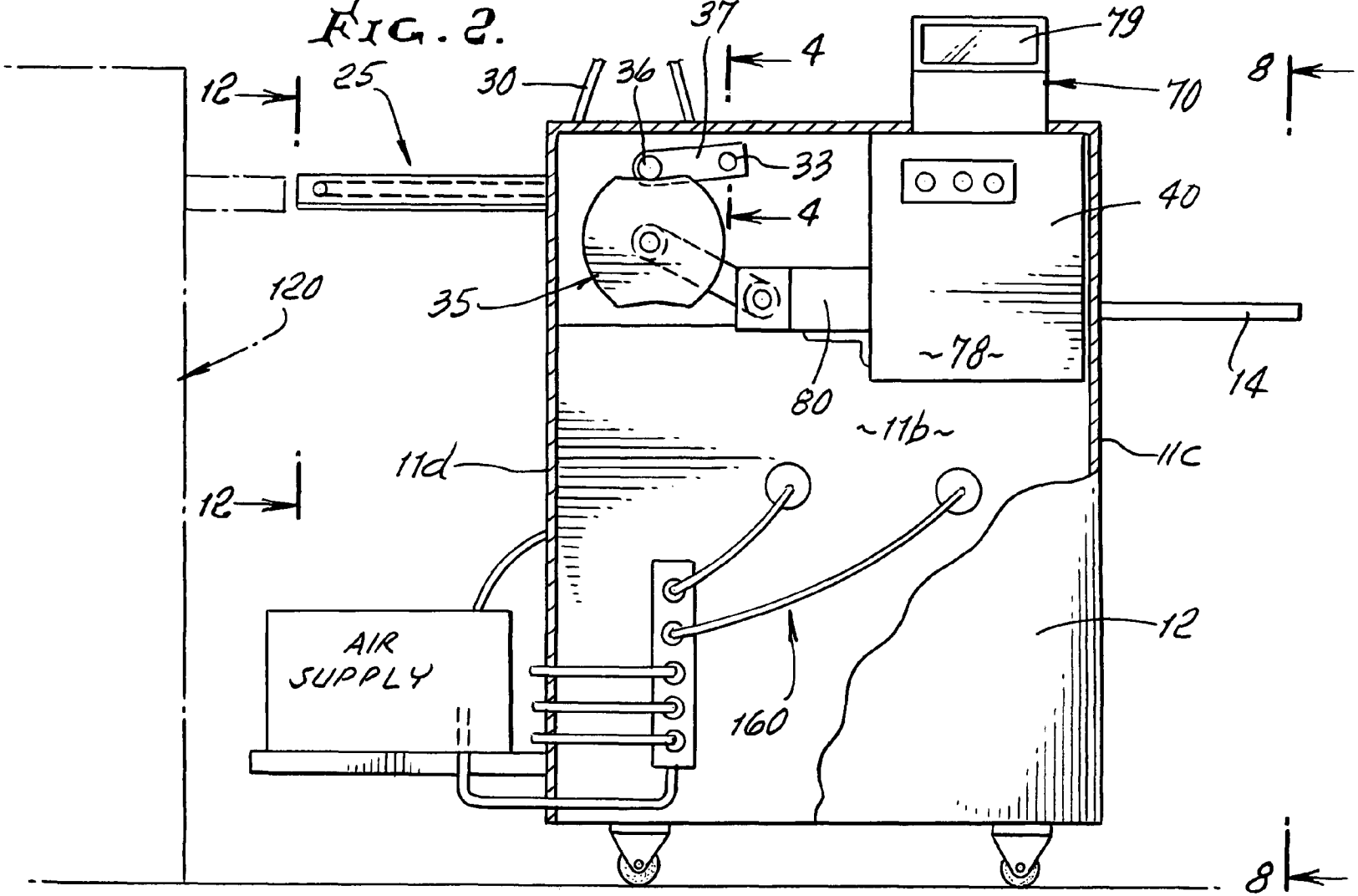
FIG. 2 is an elevation taken on lines 2-2 of FIG. 1.

A pivoting drive for elevating and lowering shaft 17 is shown in FIGS. 2 and 6*a* to include a rotary cam 35, a cam follower 36 that is elevated and lowered, cyclically, as the cam is rotated, a link 37 carrying follower 36, and a cam rotary drive 38.

Accordingly, a first shaft (as at 33) is provided to be cyclically rotatable, i.e. pivotable, to control up-down movement of the suction means, and a second shaft (as at 17) is provided to be cyclically rotatable, i.e. pivotable, to control lateral swinging movement of the suction means, the two shafts typically extending in parallel relation, for simplifying and integrating or synchronizing the two cyclic motions, for efficient, controllable and highly reliable sheet transfer and feeding from a stack, onto a conveyor. A drive controller is indicated at 40, and a conveyor controller 40*a*, in FIG. 15. See also touch screen 69 and manual mode control 69*a* in FIGS. 16 and 17.

Also, provided is an optical control means to determine the level of an upper paper or papers in the stack to control the vertical positioning of papers in the stack, for enabling said upwardly and laterally sheet delivery as the stack height progressively diminishes.

Figure 3:
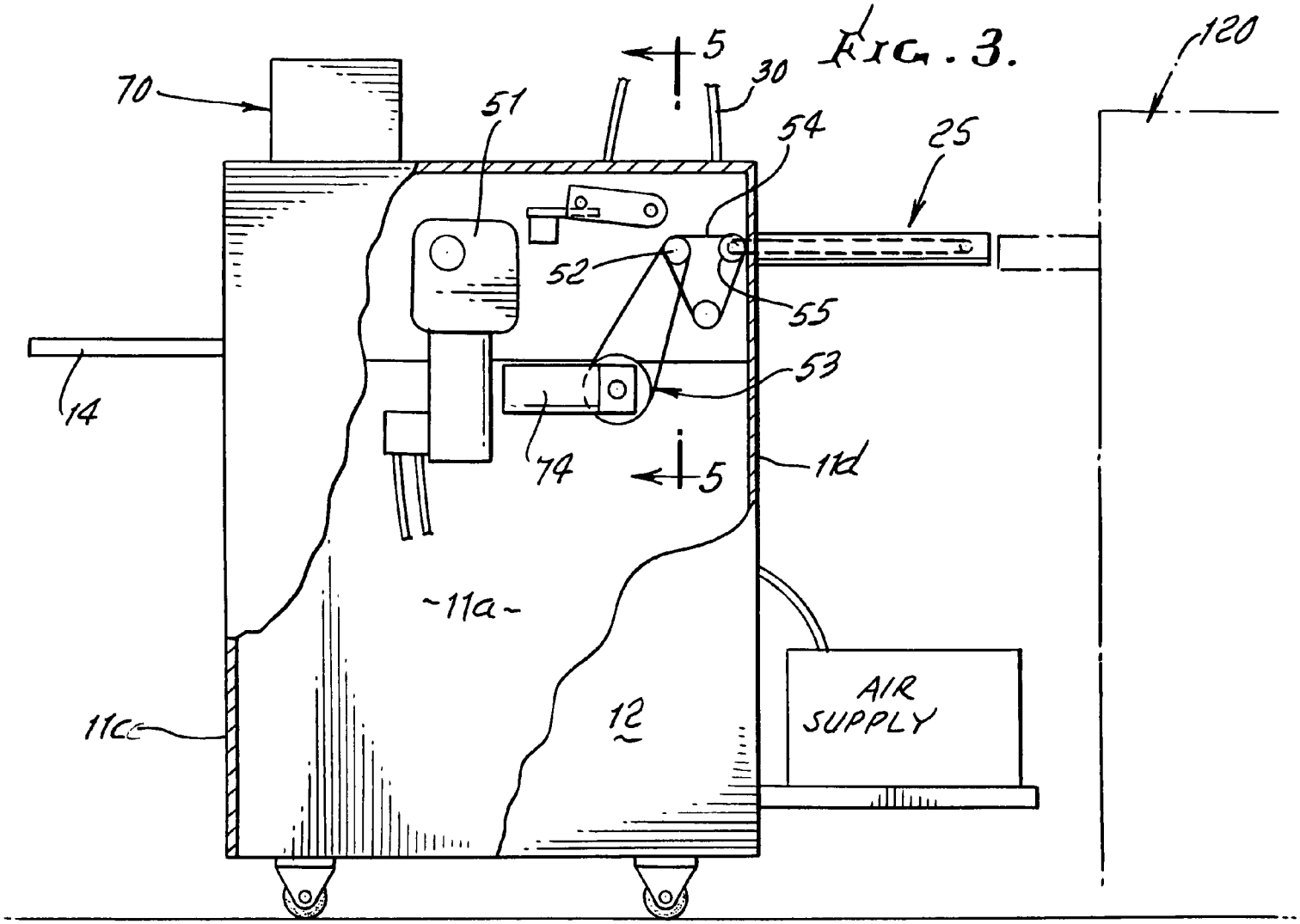
FIG. 3 is an elevation taken on lines 3-3 of FIG. 1.

As illustrated, the optical control means includes an optical sensor 44 positioned for sensing the top level of the paper stack 13. See for example electric eye 45 in FIGS. 10 and 11 sensing paper level in the stack, and operatively connected to a table upward drive or lifting assembly 46, including chains 46*a* whereby the table 14 is progressively and controllably elevated to maintain the top sheet in the paper stack at predetermined level to enable top sheet suction pick-up and lateral transfer, as described. FIG. 3 shown an up-down drive motor 51 for driving the lifting assembly 46 for table 14 vertically, for paper top level control.

FIG. 3 also shows a drive 53 for a shaft 52 carrying feed rollers 20. That drive may also include a simultaneously driver belt 54 for driving the conveyor drive roller 55, for simplification of drives, and for enabling paper delivery and conveyor travel at the same or synchronized speed. Accordingly, a drive means is provided for delivering paper sheets from the first means as referred to the conveyor, at controlled and matched rates.

Also shown in the drawings are the hoses and nozzles 60 and 61 positioned to deliver jets of air onto paper being transported, to prevent paper sticking or adhering to other paper or apparatus elements. Air supply is via hose 60*a*.

Details of the conveyor appear in FIGS. 13 and 14. See belts 66 and rolls 67, and cross shaft 68.

Additional elements shown in FIG. 1 are:

control panel 70
cam motor 71
lifting shaft 72
drive motor 74
up/down motor 75
optional large sheet 76 to be conveyed
paper stop 77.

Additional elements shown in FIG. 2 include:

control panel 78
display 79
air hoses 160
motor 80

Additional elements of the paper lifting assembly shown in FIG. 9 include:

shaft 82 from up/down motor
driven chain 83
weight 84
up/down mechanism 85.

FIGS. 18 and 19 schematically show mechanism for control of suction or vacuum application to the top paper lifting cups 16*a*. In FIG. 18 a suction line 100 supplies suction to the hoses 30 that extend to the cups, the source of suction shown at 101. A gate or valve element is movable relatively into and out of the line 100; alternatively the line 100 may have a side port 102, closed by a swingable gate or lever 103 in down position as shown, and opened when the lever or gate is pivoted upwardly about pivot 104. Downward pressure applied at 105 swings the gate clockwise, and a spring 106 yieldably resists such swinging, and acts to close the gate downwardly when pressure at 105 is relieved.

Means is provided to control pressure application at 105, in reference to swinging of another lever 107, as about a pivot 108, as effected by lifting of the suction cups 16*a* along with swinging of lever or link 34 as seen in FIG. 7. For example, a bolt 109 or other pusher on lever 107 may be displaced downwardly to apply pressure at 105. The downward travel of bolt 109 is adjusted to that lever or gate 102 is pivoted (to prevent or reduce suction application to the cups) only after the cups have been transported to FIG. 7 position to edgewise deliver the top paper in the stack to the feeder rolls.

When the leftward end 103*a* of lever 103 is lifted, it rides past shoulder 111 on block 112, and enters in notch 113 to temporarily hold the lever 103 in up position. Block 112 pivots about pivot 114 to allow such holding.

As lever 107 return pivots clockwise, the upper end 116*a* of an adjustable actuator screw 116 swings upwardly to engage a projection 117 on block 112, pivoting the block notch 113 clockwise away from the lever 107. Lever 107 is thereby released from notch 113, and pivots downwardly to close the side port 102 in vacuum line 100 for re-establishing suction in line 100, applicable to the suction cups. Thus, pivoting of lever 107 controls both pivoting of lever 103 and of block 112.

Accordingly, a simple, effective, and reliable multiple lever mechanism is provided and operated to repeatedly and alternately apply and relieve suction at the suction cups, in timed relation and lifting of those cups, so that the top sheets in the stack are lifted and released, for travel on the conveyor.

Actuator screw 116 is threadably adjustable in lever extension 107*a* to fine tune the timing of its engagement with projection 117, whereby suction timing at the cups is accurately adjustable.

I claim:

1. In a paper feeder apparatus, the combination comprising;

a) first means including a support for a paper stack and transfer elements for successively transferring paper sheets from the top of the stack upwardly and laterally to a delivered position, b) and optical control means to determine the level of an upper paper or papers in the stack to control the vertical positioning of papers in the stack, to enable said upwardly and laterally sheet delivering as the stack height diminishes, and c) a controller for cyclically controlling said transfer elements to integrate cyclic upward and lateral movement of successive sheets transferring from the stack, d) said transfer elements including operating means including suction elements to alternately adhere to top papers in the stack, and to release the top papers after their transfer toward conveyor means, said operating means including swingable parts to control suction delivery to the suction elements in timed relation to elevation of the suction elements with top papers attached, e) and whereas said parts include a first lever swingable to control said suction delivery, and a second lever movable in response to elevation movement of the suction elements, accompanied by actuation of the first lever, f) and including captivating means to temporarily captivate the first lever in swung position and during a dwell interval and until the second lever returns toward a position of first lever de-activation, said captivating means being movable by the second lever to release the first lever to swing toward a position in which suction to the suction elements is re-established.

2. The combination of claim 1 wherein said optical control means includes an optical sensor positioned for sensing the top level of the paper stack, for controlling the vertical position of a table supporting the stack.

3. The combination of claim 2 wherein said sensor comprises an electric eye.

4. The combination of claim 1 wherein up-down cyclic operation of said suction means is controlled by a controller cam.

5. The combination of claim 4 wherein said suction elements are on a transverse shaft that is bodily movable under the control of the controller cam.

6. The combination of claim 4 including a first shaft cyclically rotatable to control up-down movement of the suction means, and a second shaft cyclically rotatable to control lateral movement of the suction means, said shafts extending in parallel relation.

7. The combination of claim 6 including drives for said shafts controlling cyclic pivoting thereof in predetermined sequence.

8. The combination of claim 7 including a paper conveyor drive operatively connected to one of said shafts.

9. The combination of claim 1 wherein said one of the transfer elements comprises a suction means operable to successively adhere to top papers in the stack during up-down cyclic operation of said suction means as controlled by a controller cam.

10. The combination of claim 1 including a conveyor to which paper sheets are delivered, and drive means for delivering paper sheets from said first means to the conveyor, at controlled rates.

11. The combination of claim 1 including a threaded component carried by the second lever and engageable with a shoulder on the captivating means to adjust the timing of swinging of the captivating means to release the first level, thereby adjusting the timing of suction re-establishment.

12. The combination of claim 1 wherein said captivating means is a pivoted block.

* * * * *